US007290292B1

(12) United States Patent
Nellon

(10) Patent No.: US 7,290,292 B1
(45) Date of Patent: Nov. 6, 2007

(54) COMBINED SOLAR POWERED FAN AND HAT ARRANGEMENT FOR MAXIMIZING AIRFLOW THROUGH THE HAT

(76) Inventor: Tommie L. Nellon, 1425 N. Farris, Fresno, CA (US) 93727

( * ) Notice: Subject to any disclaimer, the term of this patent is extended or adjusted under 35 U.S.C. 154(b) by 406 days.

(21) Appl. No.: 11/096,525

(22) Filed: Apr. 4, 2005

(51) Int. Cl.
*A42C 5/04* (2006.01)

(52) U.S. Cl. ..... 2/171.3; 2/209.13

(58) Field of Classification Search ..... 2/171.3, 2/171.4

See application file for complete search history.

(56) References Cited

U.S. PATENT DOCUMENTS 4,551,857 A * 11/1985 Galvin ..... 2/7
4,680,815 A 7/1987 Hirsch et al.
D297,584 S 9/1988 Lenox et al.
4,893,356 A 1/1990 Waters
5,085,231 A 2/1992 Johnson
5,425,620 A * 6/1995 Stroud ..... 416/63
6,032,291 A * 3/2000 Asenguah et al. ..... 2/171.3
6,760,925 B1 * 7/2004 Maxwell ..... 2/171.3
7,143,451 B2 * 12/2006 Lundgren ..... 2/171.3

* cited by examiner

*Primary Examiner*—Katherine Moran

(57) ABSTRACT

An apparatus includes a hat including a unitary brim that is provided with spaced inner and outer edges defining a slope traveling downwardly and outwardly towards the outer edge. The hat further includes a raised head region including a pair of spaced and coextensive apex regions and a trough intercalated therebetween. The hat has an oblong opening disposed at the rear of the head region for allowing air to flow outwardly from the head region at a rate equal to at least twice an inlet air flow rate. A motorized fan is mounted to a front side of the head region and subjacent to the trough. Solar panels are connected to a top surface of the brim. A sleeve is formed along an interior surface of the hat that extends from the solar panels and is connected to the fan for housing electrical leads coupled thereto.

15 Claims, 2 Drawing Sheets

COMBINED SOLAR POWERED FAN AND HAT ARRANGEMENT FOR MAXIMIZING AIRFLOW THROUGH THE HAT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to hats and, more particularly, to a combined solar powered fan and hat arrangement for maximizing airflow through the hat.

2. Prior Art

Many sports fans have experienced the enjoyment of watching an outdoor sporting event while suffering the effects of high heat and humidity. In an attempt to overcome this problem, various hats or caps have been designed to include fans powered by a motor. The power source for the motor of the fan has included either solar power, electric battery power, or the choice of using either solar power or electric battery power. These hats include two separate components, with the power source usually being on top or inside the hat and with the fan usually located in the top or the brim of the hat.

In such a design, the air flow created by the fan is directed at the wearer's face. Although this design may relieve the person to a certain extent, and prevent sweat from running into their eyes, it is not the most optimal design for a maximal cooling effect. It is well known that the most amount of heat loss occurs through a person's head, in the region where one's hair is located. For this reason, runners are advised not to wear a hat when running because the heat generated by their bodies can not escape from under the hat, which may lead to excessive sweating and subsequently, heat exhaustion or heat-stroke. A more optimal direction of airflow would thus be across the top of a person's head.

Another shortcoming of many hats with solar powered fans incorporated therewith is the fan itself. Such fans are usually of a flimsy plastic design that is not sufficient for creating a significant amount of airflow over an extended period of time. Furthermore, the blades of the fans tend to be easily bent or broken, thus rendering the cooling means ineffective or useless. Thus, a more powerful and structurally rigid fan, such as those used for cooling the interior of computer towers, is desirable.

Accordingly, a need remains for a combined solar powered fan and hat arrangement for maximizing airflow through the hat in order to overcome the above-noted shortcomings. The present invention satisfies such a need by providing a combined solar powered fan and hat that is comfortable to use in many situations, novel in design, and reasonably priced. When the fan is activated, a cooling sensation is provided that travels throughout the user's body, thus, not only cooling their head and face. Such a combined fan and hat allows the wearer to engage in various outdoor activities, such as watching sports, going to the beach, working in the garden or outdoors etc., for longer periods of time. In addition, the combined hat and solar powered fan reduces the incidence of heat exhaustion, heat stroke, and skin cancer originating on the sensitive skin of one's face.

BRIEF SUMMARY OF THE INVENTION

In view of the foregoing background, it is therefore an object of the present invention to provide a combined solar powered fan and hat arrangement for maximizing airflow through the hat. These and other objects, features, and advantages of the invention are provided by an apparatus for protecting a user's head from undesirable UV light while ventilating stagnant air emanating from a user's head.

The apparatus includes a hat formed from straw material and including a unitary and continuous brim that has an annular shape. Such a brim is provided with radially spaced inner and outer edges wherein the inner edge is positioned above the outer edge for effectively defining a smooth slope traveling downwardly and outwardly towards the outer edge. The hat further includes a raised head region monolithically formed with the inner edge of the brim. Such a head region has a pair of spaced apex regions equidistantly offset from a centrally registered longitudinal axis that bifurcates the hat. The apex regions are coextensive and extend along a longitudinal length of the head region. Such a head region further has a rectilinear trough intercalated between the apex regions and monolithically formed therewith. The trough effectively channels humid and stagnant air upwardly towards the apex regions for advantageously maximizing a vertical separation between the user's head and the head region of the hat.

The hat has an oblong opening formed within the head region in which the opening is sized and shaped for effectively allowing air to flow outwardly from the hat region at a rate equal to at least twice an inlet air flow rate of the motorized fan. Such an opening is disposed at a rear of the hat region and centrally registered between the apex regions.

A motorized fan is directly mounted to a front side of the head region and registered subjacent to the trough for channeling the humid and stagnant air along a rectilinear and horizontal path beneath the trough. Such a motorized fan preferably operates at between 1500-2500 revolutions per minute. The motorized fan may produce up to 10 cubic feet per minute of air flow at a maximum rotating speed.

The motorized fan is further preferably situated to an exterior of the hat and is diametrically opposed from the opening in such a manner that a continuous and unobstructed path is effectively defined between the motorized fan and the opening. Such a motorized fan may further be horizontally registered with the opening. A plurality of flat solar panels are directly connected to a top surface of the brim and equidistantly spaced adjacent to the outer edges for effectively absorbing a maximum quantity of light rays emitting from above.

The hat further includes a sleeve formed along an interior surface thereof. Such a sleeve directly extends from each of the solar panels and is directly connected, with no intervening elements, to the motorized fan for conveniently housing electrical leads electrically coupled thereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
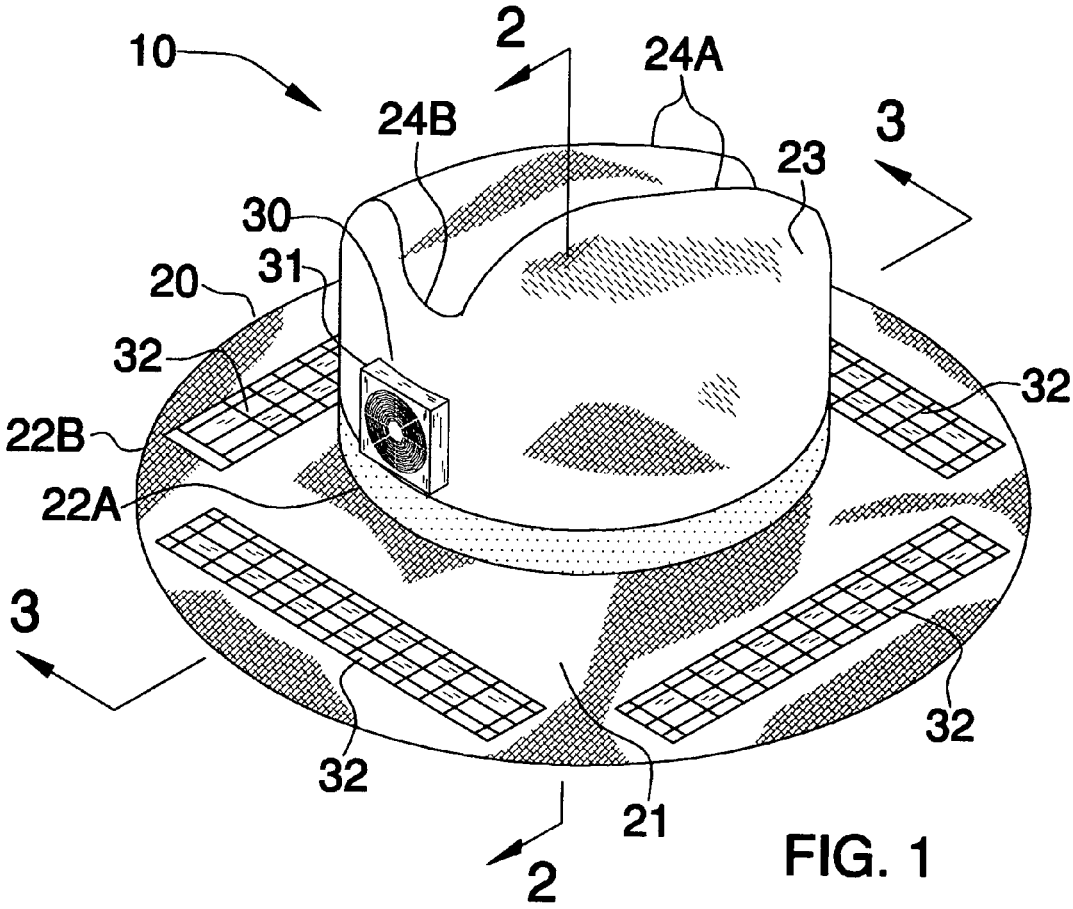
FIG. 1 is a perspective view showing a combined solar powered fan and hat arrangement for maximizing airflow through the hat, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide a combined solar powered fan and hat arrangement for maximizing airflow through the hat. It should be understood that the apparatus 10 may be used to provide improved airflow in many different types of hats and should not be limited in use to only wide brim straw hats.

Referring initially to FIG. 1, the apparatus 10 includes a hat 20 formed from straw material and including a unitary and continuous brim 21 that has an annular shape. Of course, such a hat 20 may be produced from a variety of alternate materials and have a variety of different shapes, sizes and colors, as is obvious to a person of ordinary skill in the art. Such a brim 21 is provided with radially spaced inner 22A and outer 22B edges wherein the inner edge 22A is positioned above the outer edge 22B, which is crucial for effectively defining a smooth slope traveling downwardly and outwardly towards the outer edge 22B. Such a downwardly facing slope is also important and advantageous for allowing any perspiration that may accumulate on a person's face at the inner edge 22A to run outwardly and away from the wearer's face and eyes towards the outer edge 22B.

Figure 2:
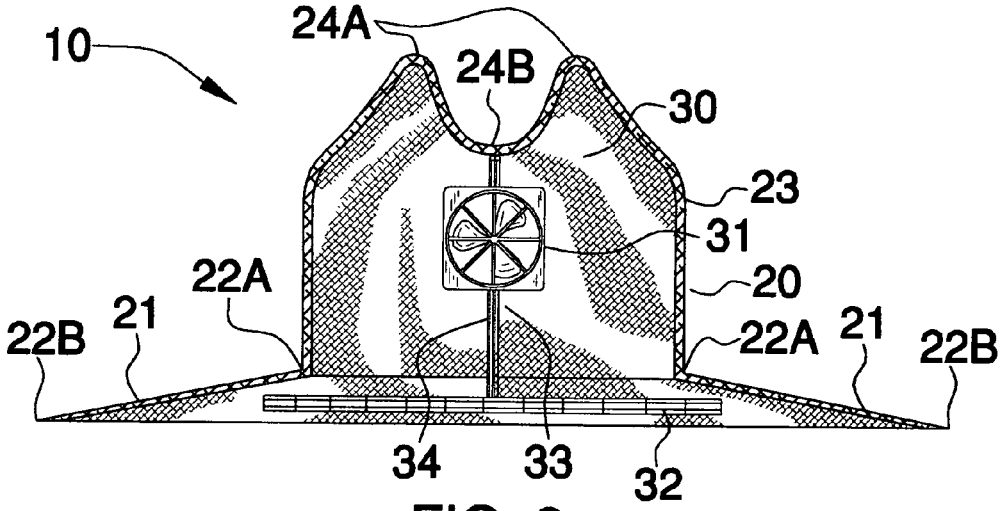
FIG. 2 is a cross-sectional view of the apparatus shown in FIG. 1, taken along line 2-2.

Referring to FIGS. 1 and 2, the hat 20 further includes a raised head region 23 monolithically formed with the inner edge 22A of the brim 21. Such a head region 23 has a pair of spaced apex regions 24A equidistantly offset from a centrally registered longitudinal axis that bifurcates the hat 20. The apex regions 24A are coextensive and extend along a longitudinal length of the head region 23. Such a head region 23 further has a rectilinear trough 24B intercalated between the apex regions 24A and monolithically formed therewith. The trough 24B is essential for effectively channeling humid and stagnant air upwardly towards the apex regions 24A for advantageously maximizing a vertical separation between the user's head and the head region 23 of the hat 20, thus allowing that area to be cooled by the fan 30 (described herein below). Such a structurally arranged of the hat is critical to the true scope and spirit of the present invention.

Figure 3:
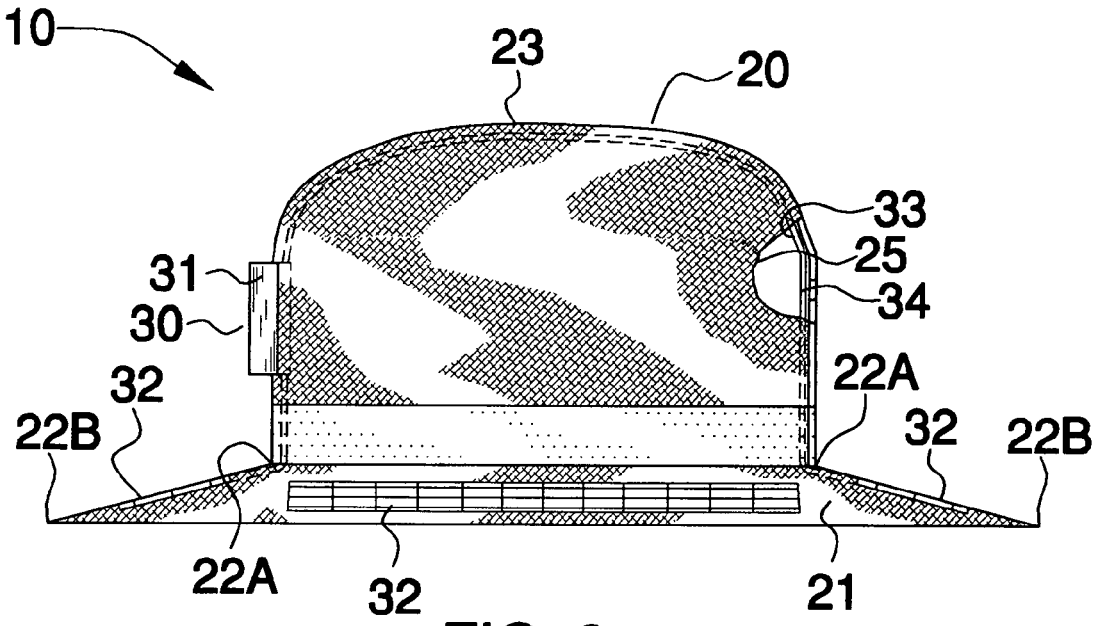
FIG. 3 is a side-elevational view of the apparatus shown in FIG. 1, taken along line 3-3.
Figure 4:
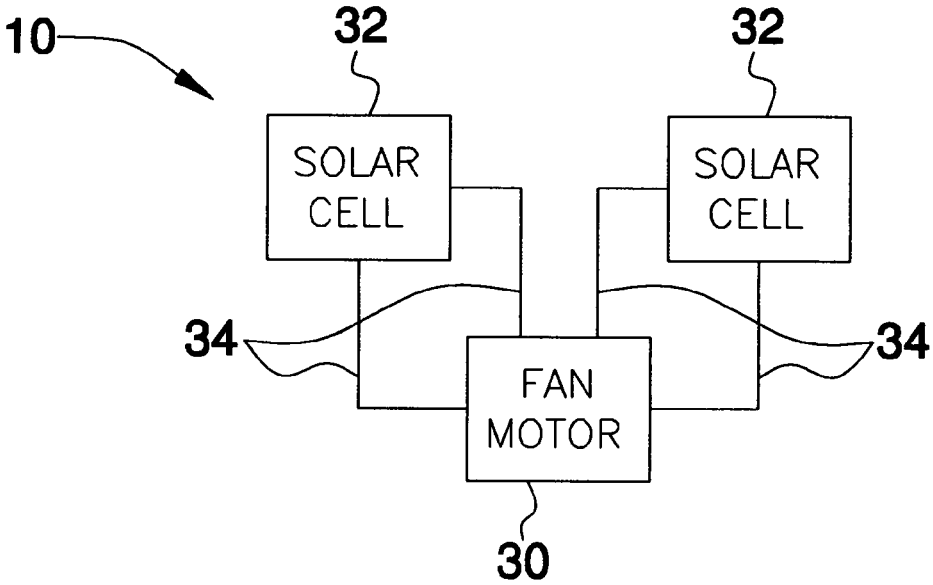
FIG. 4 is a schematic block diagram of the apparatus shown in FIG. 1.

Referring to FIG. 3, the hat 20 has an oblong opening 25 formed within the head region 23 in which the opening 25 is sized and shaped for effectively allowing air to flow outwardly from the head region 23 at a rate equal to at least twice an inlet air flow rate of the motorized fan 30. Such an opening 25 is disposed at a rear of the hat region and is centrally registered between the apex regions 24A. The opening 25 is critical for improving the airflow in the head region 23 over airflow created in conventional hats with a closed design in their respective head regions. Also, the size of the opening is critical for allowing approximately twice the volume of inlet air to escape from the hat.

Referring to FIGS. 1 through 4, a motorized fan 30 is directly mounted to a front side of the head region 23 and registered subjacent to the trough 24B, which is important for channeling the humid and stagnant air along a rectilinear and horizontal path beneath the trough 24B, thus advantageously preventing the trough 24B from impeding the airflow. Such a motorized fan 30 operates at between 1500-2500 revolutions per minute and produces up to 10 cubic feet per minute of air flow at a maximum rotating speed. Of course, the apparatus 10 may include more than one fan 30 situated adjacent to each other, and may include fans 30 with alternate operating parameters, as is obvious to a person of ordinary skill in the art.

Referring to FIGS. 1 through 3, the motorized fan 30 is further situated to an exterior of the hat 20 and is diametrically opposed from the opening 25 in such a manner that is vital for effectively defining a continuous and unobstructed path between the motorized fan 30 and the opening 25. Of course, the motorized fan 30 may be positioned at an interior of the head region 23, as is obvious to a person of ordinary skill in the art. Such a motorized fan 30 is horizontally registered with the opening 23. Of course, the motorized fan 30 may include a control switch directly mounted to the housing 31 thereof such that the user can advantageously quickly toggle the fan 30 between active and inactive modes, as is obvious to a person of ordinary skill in the art.

Referring to FIGS. 1 through 4, a plurality of flat solar panels 32 are directly connected, with no intervening elements, to a top surface of the brim 21 and equidistantly spaced adjacent to the outer edge 22B, which is critical for effectively absorbing a maximum quantity of light rays emitting from above. Such solar panels 32 advantageously eliminate the need for a bulky battery pack that would only cause discomfort to the wearer of the hat 20 and result in the apparatus 10 being heavier than is needed.

Referring to FIGS. 2 and 3, the hat 20 further includes a sleeve 33 formed along an interior surface thereof. Such a sleeve 33 directly extends from each of the solar panels 32 and is directly connected, with no intervening elements, to the motorized fan 30 for conveniently housing electrical leads 34 electrically coupled thereto. The sleeve 33 is important and advantageous for preventing the electrical leads 34 from being exposed to the wearer's skin and hair, thus improving the convenience and comfort associated with wearing the hat 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for protecting a user's head from undesirable UV light while ventilating stagnant air emanating from a users head, said apparatus comprising:

a hat formed from straw material and including a unitary and continuous brim having an annular shape, said brim being provided with radially spaced inner and outer edges wherein said inner edge is positioned above said outer edge for defining a smooth slope traveling downwardly and outwardly towards said outer edge, said hat further including a raised head region monolithically formed with said inner edge of said brim, said head region having a pair of spaced apex regions equidistantly offset from a centrally registered longitudinal axis bifurcating said hat, said apex regions being coextensive and extending along a longitudinal length of said head region, said head region further having a rectilinear trough intercalated between said apex regions and monolithically formed therewith, said trough channeling humid and stagnant air upwardly towards said apex regions for maximizing a vertical separation between the user's head and said head region of said hat;

a motorized fan directly mounted to a front side of said head region and registered subjacent said trough for channeling the humid and stagnant air along a rectilinear and horizontal path beneath said trough; and a plurality of flat solar panels directly connected to a top surface of said brim and equidistantly spaced adjacent said outer edges for absorbing a maximum quantity of light rays emitting from above;

wherein said hat has an oblong opening formed within said head region in which the opening is sized and shaped for allowing air to flow outwardly from said hat region at a rate equal to at least twice an inlet air flow rate of said motorized fan;

wherein said hat further includes a sleeve formed along an interior surface thereof, said sleeve directly extending from each said solar panels and directly connecting to said motorized fan for housing electrical leads electrically coupled thereto.

2. The apparatus of claim 1, wherein said motorized fan operates at between 1500-2500 revolutions per min.

3. The apparatus, of claim 1, wherein said motorized fan produces up to 10 cubic feet per minute of air flow at a maximum rotating speed.

4. The apparatus of claim 1, wherein said motorized fan is situated exterior of said hat and is diametrically opposed from the opening in such a manner that a continuous and unobstructed path is defined between said motorized fan and the opening.

5. The apparatus of claim 1, wherein said motorized fan is horizontally registered with the opening.

6. An apparatus for protecting a user's head from undesirable UV light while ventilating stagnant air emanating from a users head, said apparatus comprising:

a hat formed from straw material and including a unitary and continuous brim having an annular shape, said brim being provided with radially spaced inner and outer edges wherein said inner edge is positioned above said outer edge for defining a smooth slope traveling downwardly and outwardly towards said outer edge, said hat further including a raised head region monolithically formed with said inner edge of said brim, said head region having a pair of spaced apex regions equidistantly offset from a centrally registered longitudinal axis bifurcating said hat, said apex regions being coextensive and extending along a longitudinal length of said head region, said head region further having a rectilinear trough intercalated between said apex regions and monolithically formed therewith, said trough channeling humid and stagnant air upwardly towards said apex regions for maximizing a vertical separation between the user's head and said head region of said hat;

a motorized fan directly mounted to a front side of said head region and registered subjacent said trough for channeling the humid and stagnant air along a rectilinear and horizontal path beneath said trough; and a plurality of flat solar panels directly connected to a top surface of said brim and equidistantly spaced adjacent said outer edges for absorbing a maximum quantity of light rays emitting from above;

wherein said hat has an oblong opening formed within said head region in which the opening is sized and shaped for allowing air to flow outwardly from said hat region at a rate equal to at least twice an inlet air flow rate of said motorized fan, the opening being disposed at a rear of said hat region;

wherein said hat further includes a sleeve formed along an interior surface thereof, said sleeve directly extending from each said solar panels and directly connecting to said motorized fan for housing electrical leads electrically coupled thereto.

7. The apparatus of claim 6, wherein said motorized fan operates at between 1500-2500 revolutions per min.

8. The apparatus, of claim 6, wherein said motorized fan produces up to 10 cubic feet per minute of air flow at a maximum rotating speed.

9. The apparatus of claim 6, wherein said motorized fan is situated exterior of said hat and is diametrically opposed from the opening in such a manner that a continuous and unobstructed path is defined between said motorized fan and the opening.

10. The apparatus of claim 6, wherein said motorized fan is horizontally registered with the opening.

11. An apparatus for protecting a user's head from undesirable UV light while ventilating stagnant air emanating from a users head, said apparatus comprising:

a hat formed from straw material and including a unitary and continuous brim having an annular shape, said brim being provided with radially spaced inner and outer edges wherein said inner edge is positioned above said outer edge for defining a smooth slope traveling downwardly and outwardly towards said outer edge, said hat further including a raised head region monolithically formed with said inner edge of said brim, said head region having a pair of spaced apex regions equidistantly offset from a centrally registered longitudinal axis bifurcating said hat, said apex regions being coextensive and extending along a longitudinal length of said head region, said head region further having a rectilinear trough intercalated between said apex regions and monolithically formed therewith, said trough channeling humid and stagnant air upwardly towards said apex regions for maximizing a vertical separation between the user's head and said head region of said hat;

a motorized fan directly mounted to a front side of said head region and registered subjacent said trough for channeling the humid and stagnant air along a rectilinear and horizontal path beneath said trough; and a plurality of flat solar panels directly connected to a top surface of said brim and equidistantly spaced adjacent said outer edges for absorbing a maximum quantity of light rays emitting from above;

wherein said hat has an oblong opening formed within said head region in which the opening is sized and shaped for allowing air to flow outwardly from said hat region at a rate equal to at least twice an inlet air flow rate of said motorized fan, the opening being disposed at a rear of said hat region and centrally registered between said apex regions;

wherein said hat further includes a sleeve formed along an interior surface thereof, said sleeve directly extending from each said solar panels and directly connecting to said motorized fan for housing electrical leads electrically coupled thereto.

12. The apparatus of claim 11, wherein said motorized fan operates at between 1500-2500 revolutions per min.

13. The apparatus, of claim 11, wherein said motorized fan produces up to 10 cubic feet per minute of air flow at a maximum rotating speed.

14. The apparatus of claim 11, wherein said motorized fan is situated exterior of said hat and is diametrically opposed from the opening in such a manner that a continuous and unobstructed path is defined between said motorized fan and the opening.

15. The apparatus of claim 11, wherein said motorized fan is horizontally registered with the opening.

* * * * *